United States Patent [19]

Ditcher

[11] Patent Number: 4,719,724

[45] Date of Patent: Jan. 19, 1988

[54] PRECAST CONCRETE MANHOLE ADJUSTABLE BOLT SLOT ASSEMBLY FOR SECURING CAST IRON FRAME AND COVER

[75] Inventor: Jack Ditcher, Langhorne, Pa.

[73] Assignee: A-LOK Products, Inc., Tullytown, Pa.

[21] Appl. No.: 865,539

[22] Filed: May 21, 1986

Related U.S. Application Data

[63] Continuation of Ser. No. 632,392, Jul. 19, 1984, Pat. No. 4,618,464.

[51] Int. Cl.[4] ..... E02D 29/14

[52] U.S. Cl. ..... 52/20; 52/21; 52/710; 52/711; 249/205

[58] Field of Search ..... 52/710, 711, 20, 21, 52/224, 264; 249/205

[56] References Cited

U.S. PATENT DOCUMENTS

| | | | |
|---|---|---|---|
| 1,035,525 | 8/1912 | Bright | 52/710 |
| 1,037,242 | 9/1912 | Grinnell | 52/710 |
| 1,172,664 | 2/1916 | Banes | 52/710 |
| 1,386,509 | 8/1921 | Kirmes et al. | 52/711 |
| 2,108,107 | 2/1938 | Dewees | 52/710 |
| 2,181,740 | 11/1939 | Reiland | 52/710 |
| 3,095,672 | 7/1963 | Di Tullio et al. | 52/710 |
| 3,263,378 | 8/1966 | Dorris | 52/20 |
| 3,643,983 | 2/1972 | Ludeman | 285/363 |
| 3,667,174 | 6/1972 | Arnett | 52/710 |
| 3,918,224 | 11/1975 | Sundequist | 52/710 |
| 3,926,330 | 12/1975 | Deming et al. | 174/65 R |
| 3,964,219 | 6/1976 | Hala | 52/707 |
| 3,965,630 | 6/1976 | Roberts | 52/224 |
| 4,141,190 | 2/1979 | Shimada | 52/711 |
| 4,195,457 | 4/1980 | Kissling et al. | 52/285 |
| 4,389,539 | 6/1983 | Slater et al. | 174/65 R |

FOREIGN PATENT DOCUMENTS

| | | | |
|---|---|---|---|
| 0649902 | 2/1979 | U.S.S.R. | 403/337 |

*Primary Examiner*—Willard E. Hoag

*Attorney, Agent, or Firm*—Louis Weinstein

[57] ABSTRACT

A top concrete section for a manhole assembly is cast with a plurality of bolt slot inserts each insert having a substantially inverted T-shaped hollow interior for slideably receiving a nut which may be moved to any desired position along the base of the insert for threadedly engaging a threaded rod employed to rigidly secure a cast iron cover frame to the top section.

The method for casting a manhole top section comprises the steps of releasably mounting each insert within the mould assembly by means of a retaining slide which itself is slideably received within a pair of holding brackets provided on each of the inner and outer mould members, the insert being substantially fully closed on all sides thereof and having a top surface formed of a thin web which is easily fractured or cut away after the top manhole section is cast. The fully enclosed insert prevents any concrete from entering into the interior thereof.

The nut may be moved along the length of the insert base in order to bring it into alignment with bolt hole centers in the cast iron frame.

11 Claims, 17 Drawing Figures

PRECAST CONCRETE MANHOLE ADJUSTABLE BOLT SLOT ASSEMBLY FOR SECURING CAST IRON FRAME AND COVER

This is a continuation of application Ser. No. 632,392, filed July 19, 1984 and now U.S. Pat. No. 4,618,464.

FIELD OF THE INVENTION

The present invention relates to manhole assemblies and more particularly to a novel manhole top section having elongated inserts for slideably receiving threaded nuts or the like enabling the threaded nuts to easily be brought into precise alignment with the bolt hole centers of a cast iron frame to be secured thereto, and to a method for producing such top sections.

BACKGROUND OF THE INVENTION

Precast concrete sanitary manholes are typically comprised of a manhole base, one or more riser sections and top section. The inner diameter of concrete manholes is typically 48 inches or greater. The inner diameter is reduced by use of the top section typically to a standard 24 inch or 30 inch diameter manhole cover normally encountered on city streets and highways. The top concrete section of a manhole is typically a reducing cone or a reducing slab having a wall with a minimum eight inch thickness at the top for load bearing of the cast iron frame which is of a thickness and strength sufficient to accept traffic loading.

Cast iron frames are typically secured to the concrete manhole structure either by being set in a bed of mortar arranged between the top of the top section and the cast iron frame or more frequently are secured to the concrete structure through the use of from 2 to 4 mounting bolts, each typically of a ¾ inch diameter. Bolts or all-thread rods are always used to secure the cast iron frame to the manhole top section when the manhole is in a flood area necessitating a water-tight mounting.

The standard practice is to set threaded bolt inserts in the top manhole section when it is being cast. The inserts must be set upon exact centers to match the bolt hole centers in the particular cast iron frame. This requires a very precise positioning and holding assembly. In addition, the bolt centers in the cast iron frames are never constant and vary according to the type of cover employed and to the personal preference of the engineers designing the system. As a result, each top concrete manhole section must be manufactured and inventoried for the particular job, requiring an unnecessarily large inventory of both finished sections and mold assemblies.

BRIEF DESCRIPTION OF THE INVENTION

The present invention is characterized by comprising apparatus and method for providing a substantially universal manhole top section adapted to accomodate substantially any bolt hole center arrangement provided in the cast iron frame to be mounted thereto, allowing the top manhole sections to be standarized and shipped to any job, thus avoiding the need for customizing the top sections.

The apparatus of the present invention comprises an elongated plastic insert and removably holding means for releasably positioning the insert in the proper alignment within the top manhole section mold assembly.

The insert is preferably formed of a suitable plastic material having a substantially T-shaped hollow interior. One end of the insert is open, to facilitate molding, and is closed by a snap-on end cap. This top surface of the insert is formed by a thin web which maintains the spacing of the insert side walls across the top of the insert during the casting of the manhole top section and which is easily fractured or cut to facilitate insertion of a threaded bolt or other like fastener.

In the preferred method, a polygonal shaped nut is initially placed within the base of the insert, the end cap is snapped on to the insert and the insert is slideably moved into engagement with a retaining handle assembly in its proper position within the mold assembly.

Thereafter, the cementitious material is poured into the mold and surrounds the insert. After the cementitious material has cured, the slideable member is removed and the cast top manhole section is removed from the inner and outer mold members. The insert is firmly held in place by the cured concrete.

The aforementioned thin web is fractured to insert the threaded member into the nut previously placed within the insert. The cast iron frame is set upon the top section with the threaded member in alignment with its associated bolt hole. The nut is tightened down against the cast iron frame, rigidly securing the cast iron frame to the top section in a water tight manner for example. The radially aligned inserts permit the nut slideably arranged therein to be moved either inwardly or outwardly along an imaginary radius to facilitate alignment of the nut and hence threaded bolt with an associated bolt hole in the cast iron frame, said inserts providing a universal top manhole section capable of having standard 24 inch or 30 inch diameter cast iron frames mounted thereto, for example.

OBJECTS OF THE INVENTION AND BRIEF DESCRIPTION OF THE FIGURES

It is therefore one object of the present invention to provide a novel insert for use in top manhole sections to facilitate securement of cast iron frames of a variety of sizes and/or bolt hole centers to the top section.

Still another object of the present invention is to provide a novel method, including apparatus for performing same, in which plastic inserts are easily and readily molded into a cast top manhole section to facilitate mounting of cast iron frames to the top section which frames may be accomodated by said inserts regardless of the arrangement of bolt hole centers thereon.

Still another object of the present invention is to provide a novel insert for use in molding a universal top manhole section capable of receiving cast iron frames having a variety of bolt hole centers and/or being of different diameters.

The above as well as other objects of the present invention will become apparent when reading the accompanying description and drawings in which.

Figures 4A, 4B, 4C, 5, 5A, 5B, 5C, 5D, 6, 6A, 7, 7A, 8:
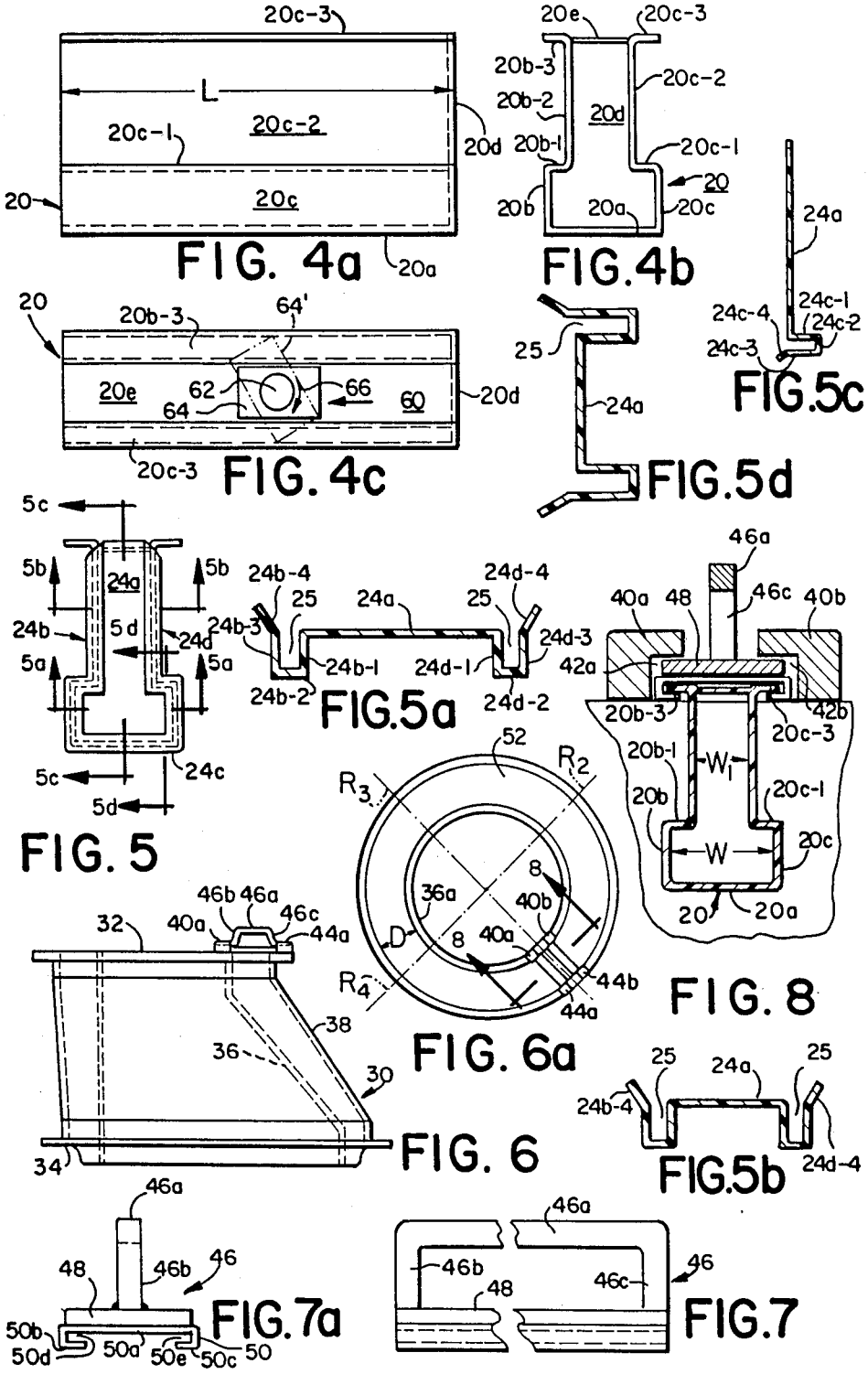
FIGS. 4a, 4b and 4c show side, end and top views respectively of the bolt slot insert of FIG. 3.
FIG. 5 shows an elevational view of an end cap which is snapped to the open end of the bolt slot insert of FIGS. 4a through 4c.

FIGS. 5a through 5d shows sectional views of the end cap of FIG. 5 looking in a direction of arrows A—A[1]; B—B[1]; C—C[1] and D—D[1].

FIG. 6 shows an elevational view of a moulding assembly for forming eccentric cone-shaped top manhole sections.

FIG. 6a is a top plan view of the mold assembly of FIG. 6.

FIGS. 7 and 7a show side and end views respectively of the retaining handle employed for positioning and supporting an insert during the casting operation for forming a manhole top section.

FIG. 8 shows a detailed sectional view of one insert showing the manner in which the slideable positioning and holding handle of FIGS. 7 and 7a maintains the insert in proper alignment during the casting operation.

DETAILED DESCRIPTION OF THE INVENTION

As is conventional in manhole assemblies, such assemblies are typically comprised of a manhole base (not shown), a riser section (not shown) and a top section, the base being provided with openings for receiving incoming and outcoming conduits and the riser and top sections being selected to provide the appropriate spacing distance between the manhole cover, which is typically at street level, and the manhole base.

The manhole base typically has an interior diameter of the order of 48 inches, as does the riser section. Since the manhole cover typically has a diameter of the order of 18 to 24 inches, the top section typically has an eccentric coneshaped configuration for reducing the diameter of the manhole assembly to receive the manhole cover.

Figure 1:
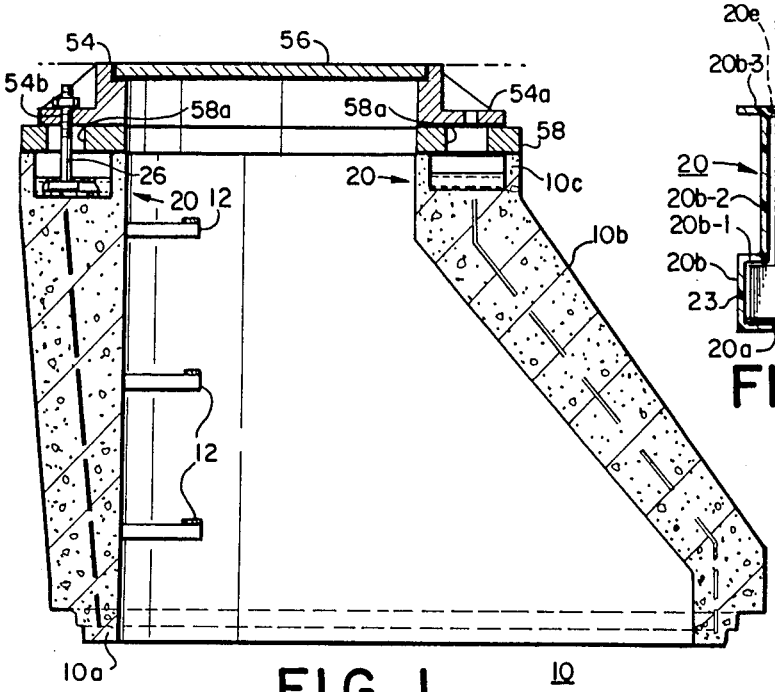
FIG. 1 shows a sectionalized elevational view of a top manhole section supporting a cast iron frame and embodying the insert of the present invention.
Figure 2:
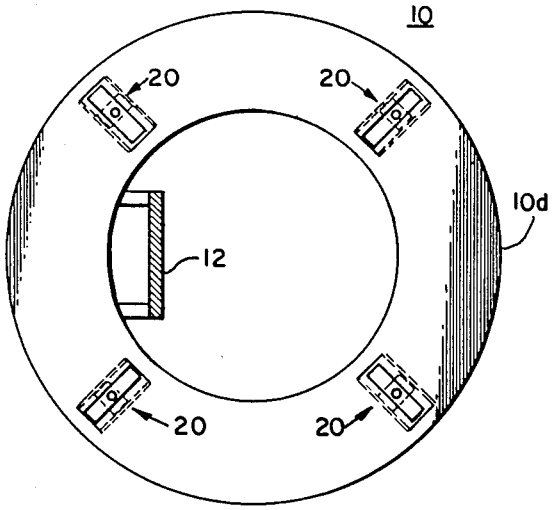
FIG. 2 shows a top plan view of the top surface of the manhole top section shown in FIG. 1 with the cast iron frame and adjustment ring removed.

Noting specifically FIGS. 1 and 2 there is shown therein a manhole top section 10 having a bottom portion 10a for resting upon and interfitting with the top surface of a riser section, not shown. The side wall has a circular cross-section and a conical shaped section 10b which tapers to a top cylindrical portion 10c of reduced diameter as compared with the bottom portion 10a of larger diameter. U-shaped inserts 12 are arranged along the interior vertical wall and collectively form a ladder to permit workmen to climb into and out of the manhole.

Figure 3:
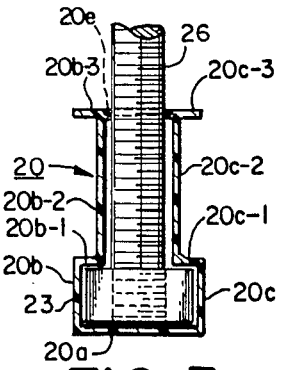
FIG. 3 shows an elevational detailed view, partially sectionalized, of an insert employed in the assembly of FIG. 1 showing the nut and threaded member assembled therein.

The top of the top section 10 terminates in an annular surface 10d which is substantially planar and is provided with a plurality of inserts 20 cast into the concrete manhole top section 10. One such insert is shown in enlarged detailed fashion in FIG. 3 and in the top, side and end views as shown in FIGS. 4c, 4a and 4b. The insert 20 has a base portion 20a. A pair of upwardly directed sides 20b and 20c integral with base 20a are bent inwardly at 20b-1 and 20c-1, upwardly at 24b-2 and 20c-2 and then outwardly to form flanges 20b-3 and 20c-3 as shown best in FIGS. 3 and 4b. The inwardly directed portions 20b-1 and 20c-1 define shoulders for holding a nut 23 within the interior of insert 20. Side wall portions 20b-2 and 20c-2 define the passageway for inserting and/or removal of a threaded rod 26. Outwardly directed flanges 20b-3 and 20c-3 serve as the means for supporting and positioning the inserts 20 during the casting operation by holding means to be more fully described in connection with FIGS. 7 and 7a.

Insert 20 has an end wall 20d sealing for example the right hand end of insert 20 as shown in FIG. 4a.

The top of the insert 20 is provided with a thin web 20e integrally joined to the side wall portions 20b-2 and 20c-2 adjacent the outwardly directed flanges 20b-3 and 20c-3, respectively. The insert 20 is completely sealed on all sides through the use of an end cap 24 having a substantially T-shaped periphery conforming to the T-shaped interior of insert 20. The end cap 24 comprises a main body portion 24a. Integral with the main body portion is a narrow continuous gripping channel 25 which extends along side wall 24b, bottom 24c and remaining side wall 24d. The gripping channel 25, is defined by a flange integrally joined to the body portion and defined along the side wall 24b by downwardly directed portion 24b-1, center portion 20b-2 and upwardly directly portion 24b-3 whose extreme end extends diagonally outwardly at 24b-4. The gripping channel 25 along side wall 24d is similarly comprised of portions 24d-1 through 24d-4 which correspond to each of the portions 24b-1 through 24b-4 of side wall 24. Similarly, the gripping channel 25 along bottom edge 24c has a like configuration formed by portions 24c-1 through 24c-4 which correspond to portions 24b-1 through 24b-4, respectively.

The channel 25 of end cap 24 is designed to snap on to the open end of insert 20 to substantially firmly embrace the insert 20 and thereby completely seal the insert 20 on all six sides. The insert 20 with the end cap 24 mounted thereto is cast into the manhole top section by means of the mold assembly 30 shown best in FIGS. 6 and 6a. The mold assembly 30 is comprised of top and bottom flange rings 32 and 34 and inner and outer mold members 36 and 38. The inner and outer mold members 36, 38 are set upon bottom flange ring 34 which is utilized to form the bottom configuration 10a of the manhole top section as shown in FIG. 1. The top flange ring 32 and the top edge 36a of inner mold member 36 are each provided with four sets of positioning lugs arranged for example at 90 degree intervals along the imaginary radial lines R1 through R4 shown in FIG. 6a. The position lug assemblies each comprise a pair of L-shaped lugs 40a, 40b welded to the top surface 36 of inner mold member 36 to form receiving channels 42a, 42b for slideably receiving and holding the long sides of retaining slide 46 in the position shown in FIG. 8, as will be more fully described. A similar pair of L-shaped lugs 44a and 44b are welded to upper flange ring 32 in a similar manner for holding the long sides of the retaining slide 46 at the opposite end of retaining slide 46. Three more such L-shaped lug assemblies are arranged along the outer and inner mold members at the positioned shown by radial lines R2 through R4 but have been omitted herein for purposes of simplicity.

The retaining slide member 46 is shown in greater detail in FIGS. 7 and 7a and is comprised of a substantially U-shaped metal handle having a gripping portion 46a and downwardly depending integral arms 46b and 46c welded at their bottom ends to a three-sixteenth inch rectangular metal plate 48. A 26 guage metallic sheet 50 has its central portion 50a brazed to the under surface plate 48. The width of sheet 50 is greater than the width of plate 48 and the free ends are 50b and 50c are bent downwardly and then inwardly to form receiving channels 50*d* and 50*e* for receiving the outwardly directed flanges 20*b*-3 and 20*c*-3 of an insert 20 as is shown best in FIG. 8. If desired, the slide member 46 may be formed of a suitable plastic material.

The manner in which a manhole top section is cast is as follows:

The mold members 32, 34, 36, 38 which are utilized to form a manhole top section are assembled to form the mold assembly as shown in FIGS. 6 and 6*a*. Before end cap 24 is snapped to the open end of insert 20, square nut 23 is dropped into the insert so as to occupy the position shown in FIG. 3. The size of the nut 23 is such that its outer diameter is preferably less than the width W across the base section of insert 20 as shown in FIG. 8 and is substantially greater than the width W1 between side wall portions 20*b*-2 and 20*c*-2, causing the nut to be captured within the base portion of insert 20 and so that the shoulders formed by side portions 20*b*-1 and 20*c*-1 prevent the nut from being moved out of the base portion of insert 20.

Although the nut 23 is prevented from moving upwardly, nut 23 is nevertheless free to be slideably moved along the entire length L (see FIG. 4*a*) of insert 20.

After nut 23 is dropped into insert 20, end cap 24 is snapped onto the open end of insert 20, sealing the insert on all sides. The insert 20, with the nut 23 and end cap 24 in place, is then positioned in the hollow region between the inner and outer mold members and adjacent to the upper ends thereof so as to be generally in alignment with the two pairs of lugs 40*a*, 40*b* and 44*a*, 44*b*. The retaining handle is than moved into place so that its long sides on opposite sides of handle 46*a* enter into the channels 42*a*, 42*b* formed by lugs 40*a*, 40*b* and the top surface 36*a* of mold member 36*a* and enter into similar channels formed between the lugs 44*a*, 44*b* and the top surface of flange ring 32. The retaining slide member 46 is moved into the aforementioned position while holding flanges 20*b*-3 and 20*c*-3 in the position shown in FIG. 8 so that flanges 20*b*-3 and 20*c*-3 enter into the channel regions 50*d* and 50*c* (see FIG. 7*a*) of the retaining slide assembly 46. The length of insert 20, including end cap 24, is preferably just slightly less than the radial distance D (see FIG. 6*a*) between the outer surface of mold member 36 and the inner surface of mold member 38.

All four insert assemblies 20 and retaining slide assemblies 46 are positioned at each of the radial locations previously mentioned. Although the preferred embodiment describes the use of four such arrangements, a greater or lesser number may be provided.

After the inserts 20 and retaining slide members 46 are installed in the manner described, the concrete is poured into the hollow interior region 52 between the inner and outer mold members (see FIG. 6*a*) filling the mold assembly to the top. After the concrete has cured, each retaining slide member 46 is moved either radially inwardly or radially outwardly in order to remove the retaining slide members 46 from the mold assembly. The inserts 20 are retained in position by the cured concrete which, in the wet state, follows the exterior contour of each insert 20 and, once cured, substantially exactly conforms to the exterior contour and shape of each insert 20, preventing the inserts from being removed from the cast top section 10. End cap 24 and top web 20*e* prevent concrete from entering into the interior of the inserts 20.

The top section 10 is then removed from the inner and outer mold assemblies and is now ready for installation and use at a job site.

The manner of use of the manhole top section 10 is as follows:

The top section 10 shown in FIG. 1 is placed upon a riser section having a top surface which conforms to the bottom end 10*a* of top section 10, assuring interlocking between the two members.

In the event that the ring-shaped cast iron frame 54 (see FIG. 1) which supports manhole cover 56 is not sufficiently up to grade level, annular adjustment rings 58 may be positioned upon the top surface of top section 10. One more of these rings may be provided. The rings 58 are provided with over sized openings 58*a* for receiving the threaded rods 26.

Once the number of adjustment rings necessary to bring the cast iron frame 54 up to grade level are placed upon top section 10, the thin web 20*e* is pierced to gain access to the interior of the insert 20. The web is preferably made sufficiently thin to allow easy removal thereof through the use of a small knife or other suitable sharp pointed instrument, for example. The web 20*e*, in addition to preventing concrete from entering into insert 20, also maintains the structural integrity of the upper end of insert 20 during the molding operation by preventing the concrete from causing the insert 20 to yield or collapse as the concrete is poured around the insert.

After web 20*e* is cut away, a threaded rod 26 is inserted through the now open upper end of insert 20 and downwardly toward the base portion containing nut 23. The bottom end of threaded rod 26 is aligned with nut 23 and is inserted into nut 23 and rotated to secure threaded rod 26 to nut 23. Preferably, two parallel sides of the nut 23 engage the interior surfaces of side walls 20*b* and 20*c* to prevent nut 23, which is preferrably a square nut, from turning as threaded rod 26 is rotated. The threaded rod 26 is chosen to be of a length sufficient to extend from the lower end of insert 20 which receives nut 23 upward through the length of insert 20 and the thickness (or thicknesses) of the adjustment ring (or rings) 58 as well as the thickness of the outer radial flange 54*a* of cast iron frame 54 to extend beyond the upper surface of flange 54*a*. The cast iron frame 54 is placed upon either the top of insert 10 or the top of the top most adjustment ring 58 (if adjustment rings are used) and in alignment with the threaded rods such as for example threaded rod 26 shown in FIG. 1. The cast iron frame 54 is then dropped into place with threaded rod 26 extending through bolt hole 54*b*. Thereafter a fastening nut 58 is threaded to the top end of threaded rod 26 and is tightened sufficiently to form a water tight securement between cast iron frame 54 and manhole top section 10. A gasket (not shown) or other suitable means may be provided to effect the water-tight seal. The manhole cover 56 rests upon an internal shoulder 54*c* of cast iron frame 54 and may be lifted off as needed in order to gain access to the manhole assembly.

The length L of the insert is sufficient to accomodate the cast iron frames of either 24 or 32 inch diameter, for example, as well as accomodating cast iron frames whose bolt hole centers are displaced from an ideal imaginary circle. In the preferred embodiment, for example, the insert 20 may have a length of the order of 6 inches, although inserts of greater or lesser length may be utilized commensurate with the distance D between mold members 36 and 38.

Figure 3A:
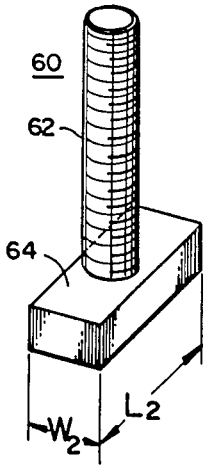
FIG. 3a is a perspective view of an alternative threaded member which may be used with the insert of FIG. 3.

As an alternative to the fastener embodiment described hereinabove employing a nut 23 and threaded rod 26, a T-shaped threaded assembly 60 as shown in FIG. 3*a* may be utilized. The assembly is comprised of an elongated threaded rod 62 whose bottom end is welded to a rectangular-shaped block or head 64 whose length L2 is substantially greater than the width W at the base of insert 20 (see FIG. 8) and whose width W2 is slightly less than the width W1 of insert 20.

T-shaped member 60 is utilized in the following manner:

When employing the T-shaped member 60 of FIG. 3*a*, the end cap 24 is snapped on to the end of insert 20 without inserting a nut. The insert is then mounted in the molding assembly as before. After the molding operation is completed in the manner described hereinabove, and once the concrete has cured, and the manhole top section 10 has been installed at a job site, at least a portion of web 20*e* is removed and the head 64 of T-shaped assembly 60 is inserted through the opening formed by removal of web 20*e* with the orientation of assembly 60 as shown in FIG. 4*c*. Once head 64 has been lowered into the base portion of insert 20 the threaded portion 62 is rotated clockwise as shown by arrow 66 so that head 64 is rotated to occupy the dotted line position 64[1] with a significant portion of the head 64 being captured by the shoulders formed by side wall portions 20*b*-1 and 20*c*-1 of insert 20 (see FIG. 8).

The T-shaped assembly 60 may be moved either toward the left or toward the right along insert 20 to line up with a bolt hole in cast iron frame 54. The T-shaped assembly 60 is mounted within insert 20 in such a manner that, when fastening nut 58 is tightened, any movement which nut 58 imparts to threaded member 62 will be in the direction of arrow 66 to prevent head 64 from moving free of the insert shoulders embracing the top edges of head 64.

The insert 20 is preferably formed of a suitable plastic material which lends itself readily to a molding operation. The preferred materials include polypropylene or PVC, although any other material exhibiting similar characteristics may be utilized, if desired.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed:

1. A combination manhole assembly and thin, lightweight insert for use as an adjustable fastener slot and to be embedded in cast concrete manhole top sections for mounting and securing a cover frame thereto by means of a threaded member, said combination comprising:

a manhole assembly including at least a base section and a top section supported thereon;

a manhole cover frame mounted upon the top surface of said top section for supporting an annular-shaped manhole cover;

said cover having a plurality bolt openings about its circumference;

a plurality of inserts being embedded at spaced intervals about the top of said top section, each of said inserts having a longitudinal axis radially aligned about said top section and comprising:

an elongated insert member formed of a T-shaped plastic shell fully enclosing a hollow interior of a substantially T-shaped cross-section defining a wide base portion and a narrow upper portion;

the free end of the narrow upper portion extending to the top surface of said top section;

the exterior periphery of said insert generally conforming to said cross-sectional configuration;

substantially the entire top surface of said insert including an elongated substantially rectangular-shaped integral web formed simultaneously with the remainder of said insert through one of the processess of molding, casting and extruding and being of a thickness substantially less than the remaining portion of the insert member and sufficiently thin to prevent the cast material from entering into the hollow interior of the insert and to facilitate the piercing, cutting away and removal of said web to form an elongated rectangular-shaped slot for insertion of a threaded member having an enlarged head portion an integral threaded portion;

said enlarged base portion slideably receiving said head portion and the narrower upper portion of the insert communicating with said base portion and extending to said web for receiving said threaded portion;

the threaded portion of each threaded member extending upwardly from said top section and through an associated opening in said cover lid frame for threaded engagement with a tapped member;

the interior region of said insert being an elongated hollow region of substantially uniform T-shaped cross-section to permit the threaded member to be slideably positioned along the length thereof;

the length of said inserts being sufficient to accomodate manhole cover frames of varying diameters and of a length of the order several inches.

2. The combination of claim 1 wherein one side of each insert is open;

an end cap including a gripping channel conforming to the shape of the insert at the open side thereof being releaseably mounted to the insert at said oen end to substantially fully enclose said insert.

3. The combination of claim 1 wherein said plastic material forming said inserts is taken from a group consisting of polypropylene and PVC.

4. The combination of claim 1 wherein each of said insert members comprises a base, two elongated side walls and one end wall integrally joined to said base and side walls at one end thereof;

the upper end of each of said side walls extending outwardly to collectively form a pair of supporting flanges;

a thin elongaged web joining the top end of said side wall adjacent said flanges for closing the top end of said insert, said web being of a thickness to facilitate easy removal thereof such as by cutting.

5. The combination of claim 4 wherein each of said inserts having at least one open side end;

an end cap has a continuous channel conforming to the shape of said insert at the open side end thereof for receiving and thereby releaseably securing the end cap to said insert and thereby completely enclosing the hollow interior of said insert to prevent cast concrete material from entering into the hollow interior of said insert.

6. A concrete manhole assembly for mounting and securing a cover frame thereto, said assembly comprising:

a hollow cylindrical-shaped cast concrete member adapted to form a section of a manhole assembly;

said member having a top surface for positioning and supporting a metallic frame adapted to position and receive a cover;

said metallic frame having a plurality of bolt slots to facilitate fastening of the frame to said cylindrical-shaped member;

a plurality of inserts radially aligned in said top surface and embedded in said cylindrical-shaped member adjacent said top surface for mounting and securing the cover frame thereto by means of a threaded member, said inserts being arranged at equispaced intervals about said top surface;

each said insert comprising an elongated hollow insert member formed of substantially T-shaped plastic shell fully enclosing the hollow interior which has a substantially T-shaped cross-section defining a wide base portion and a narrow upper portion;

the exterior periphery of said insert generally conforming to said T-shaped cross-sectional configuration;

substantially the entire top surface of said insert including an elongated substantially rectangular shaped integral web formed simultaneously with the remainder of said insert through one of the processes of molding, casting and extruding and being of a thickness of substantially less then the remaining portion of the insert member and being sufficiently thin to facilitate the piercing, cutting away and removal of said web to form an elongated rectangular-shaped slot which communicates with the top mounting surface of said cylindrical-shaped member for receipt and insertion of a threaded member having an enlarged head portion and an integral threaded portion;

said elongated insert member having an imaginary longitudinal axis which is co-aligned with an imaginary radius of said cylindrical-shaped member to facilitate alignment with a bolt slot in said cover frame;

said enlarged based portion slidably receiving the enlarged head portion of said threaded member and the narrow upper portion of the insert communicating with said base portion and extending to said web for receiving said threaded portion;

the threaded portion of said threaded member being of a length sufficient to extend through said narrow upper portion and upwardly beyond said top mounting surface and through and beyond the top of the bolt slot in said cover frame for receiving a cooperating threaded nut member for securely fastening the cover frame to the cylindrical-shaped member;

the interior region of said insert being an elongated hollow region of substantially uniform T-shaped cross-section to permit the threaded member to be slidably positioned along the length thereof which is of the order of several inches.

7. The assembly of claim 6 wherein one end of said insert is open;

an end cap including a gripping channel conforming to the shape of the insert at the open end thereof and being releasably mounted to the insert at said open end to substantially fully enclose said insert.

8. The assembly of claim 6 wherein said plastic material used to form each insert is taken from a group consisting of polypropylene and PVC.

9. The assembly of claim 5 wherein said insert member comprises a base, two elongated side walls and one end wall integrally joined to said base and side walls of one end thereof;

the upper end of each of said side walls extending outwardly to collectively form a pair of supporting flanges;

said integral web being a thin elongated web joining the top end to said side walls adjacent to said flanges for closing the end of said insert.

10. The assembly of claim 9 further comprising an end cap having a continuous channel conforming to the shape of said insert at the open end thereof for receiving and thereby releasably securing the end cap to said insert and thereby completely enclosing the hollow interior of said insert.

11. The assembly of claim 6 wherein said cover frame is provided with a plurality of bolt openings at spaced angles about the periphery of said cover frame;

a plurality of said inserts being embedded in said cast member at spaced intevals thereabout corresponding to the spaced intevals of the bolt slots openings in said cover frame;

said insert members each having an imaginary longitudinal axis which is substantially co-axial with an imaginary radius of said cylindrical-shaped member to facilitate alignment of a bolt which is slidably mounted within each of said inserts with an associated one of said bolts slots in said cover frame;

a threaded nut member threadedly engaging the threaded portion of each insert member to securely fasten said cover frame to said cylindrical-shaped member.

* * * * *

UNITED STATES PATENT AND TRADEMARK OFFICE

CERTIFICATE OF CORRECTION

PATENT NO. : 4,719,724

DATED : January 19, 1988

INVENTOR(S) : Jack Ditcher

It is certified that error appears in the above-identified patent and that said Letters Patent is hereby corrected as shown below:

IN THE CLAIMS

CLAIM 1:

Column 7, line 52, change "and" to --adapted--.

Column 7, line 61, before "having" insert --frame--.

CLAIM 2:

Column 8, line 41, change "oen" to --open--.

CLAIM 11:

Column 10, line 46, change "bolts" to --bolt--.

Signed and Sealed this

Twenty-second Day of November, 1988

*Attest:*

DONALD J. QUIGG

*Attesting Officer*

*Commissioner of Patents and Trademarks*